US011174073B1

(12) United States Patent
Ransom

(10) Patent No.: US 11,174,073 B1
(45) Date of Patent: Nov. 16, 2021

(54) PROTECTIVE COVER APPARATUS FOR BOTTLES AND CONTAINERS

(71) Applicant: David Ransom, Chandler, AZ (US)

(72) Inventor: David Ransom, Chandler, AZ (US)

( * ) Notice: Subject to any disclaimer, the term of this patent is extended or adjusted under 35 U.S.C. 154(b) by 0 days.

(21) Appl. No.: 15/931,279

(22) Filed: May 13, 2020

Related U.S. Application Data

(60) Provisional application No. 62/848,043, filed on May 15, 2019.

(51) Int. Cl.
*B65D 85/30* (2006.01)
*B65D 23/08* (2006.01)
*B65D 81/02* (2006.01)

(52) U.S. Cl.
CPC ..... *B65D 23/0885* (2013.01); *B65D 81/022* (2013.01)

(58) Field of Classification Search
CPC ..... B65D 23/0885; B65D 81/022; B65D 81/3876; B65D 81/3881
USPC ..... 206/521, 586, 591, 592, 594; 215/386, 215/395; 220/23.91, 630, 632, 703, 737, 220/739, 741, 742
See application file for complete search history.

(56) References Cited

U.S. PATENT DOCUMENTS 2,500,786 A * 3/1950 Austin ..... A61J 9/08 215/12.1
2,808,090 A * 10/1957 Casalino ..... B65D 11/16 220/62.18
3,613,761 A * 10/1971 Moody ..... B65D 11/02 215/11.6
3,719,305 A * 3/1973 Pressnell ..... A47G 23/0233 220/740
3,929,312 A * 12/1975 Uke ..... B63C 11/22 248/346.11
5,921,431 A * 7/1999 Pych ..... A47G 23/0241 220/742
6,105,799 A * 8/2000 Takagawa ..... A47J 41/026 215/12.1
9,340,323 B1 * 5/2016 Tate ..... B65D 23/0885
(Continued)

OTHER PUBLICATIONS

REUZBL Bottle Bumper, Publication Date—Oct. 19, 2018, available at https://web.archive.org/web/20181019122347/https://reuzbl.com/.

(Continued)

*Primary Examiner* — Luan K Bui
(74) *Attorney, Agent, or Firm* — Plager Schack LLP; Mark H. Plager; Naomi Mann

(57) ABSTRACT

A protective cover apparatus designed to couple to a container to minimize abrasions, deformation and damage to the container due to impact forces generated from contact with an object is provided. The container includes a top open end continuously connected to a closed bottom end by a side wall. The protective cover apparatus includes an upper bumper disposed around the container proximate the top open end, and a lower bumper coupled to the bottom closed end of the container. The lower bumper has a base continuously connected to a side wall. The base of the lower bumper has a plurality of internal ridges in contact with the bottom closed end of the container. The internal ridges of the lower bumper are designed to deform to absorb and redirect the impact forces from contact with the object away from the container.

13 Claims, 4 Drawing Sheets

(56) References Cited

U.S. PATENT DOCUMENTS

| | | | | |
|---|---|---|---|---|
| 2005/0218159 | A1* | 10/2005 | Hoour | B65D 25/205<br>222/321.7 |
| 2014/0166520 | A1* | 6/2014 | Hoppe | B65D 81/127<br>206/433 |

OTHER PUBLICATIONS

BottleArmor Protective Silicone Sleeve Cover Case—Customer Comment Published on Jan. 29, 2018, available at https://www.amazon.com/BottleArmor-Protective-Silicone-Bottles-Multiple/dp/B077R5KJK6?th=1.

Armorskins Tumbler Silicone Sleeves—Publication Date on Jan. 4, 2018, available at https://www.amazon.com/Armorskins-Tumbler-Silicone-Sleeves-Black/dp/B078MNMH6M?th=1.

* cited by examiner

PROTECTIVE COVER APPARATUS FOR BOTTLES AND CONTAINERS

RELATED APPLICATION

The application claims priority to provisional patent application U.S. Ser. No. 62/848,043 filed on May 15, 2019, the entire contents of which is herein incorporated by reference.

BACKGROUND

The embodiments herein relate generally to fluid storing containers such as flasks, bottles, canisters, and the like. More specifically, embodiments of the invention are directed to a protective cover apparatus for these containers.

Many containers such as glass or stainless steel bottles, canisters, flasks and other containers when dropped will break, become blemished, dented or damaged beyond a point of working as originally designed. Some of this occurring damage can cause glass bottles to break entirely or if made of steel or other metals, they will at times no longer stand upright due to the deformation of their structural integrity.

Current protection devices for containers such as flasks, canisters and/or bottles are light duty, thin, low-grade silicone boots or covers that focus only to provide protection against minor dents, chips, scuffs, scratches and/or abrasions caused from light impacts. Other protection devices offer less than optimal types of protection and offer little noise reduction. An example device is the REUZBL Sleeve, which provides an outer member that extends around edges of the container. These types of devices are limited because they lack significant protection from the largest culprits damaging flasks, canisters or bottles, which are high-impacts and kinetic energy from drops that result in damage to the container, thereby leaving the container entirely unusable as designed.

As such, there is a need in the industry for a protective cover apparatus for use with a wide variety of containers that addresses the limitations of the prior art, which protects the surfaces of the container from abrasions, deformation and/or other damage resulting from high-impact forces and kinetic energy from drops or contact with other objects.

SUMMARY

In certain embodiments of the invention, a protective cover apparatus with enhanced shock absorbing capability configured to couple to a container to minimize abrasions, deformation and damage to the container due to impact forces generated from contact with an object is provided. The container comprises a top open end continuously connected to a closed bottom end by a side wall. The protective cover apparatus comprises an upper bumper configured to dispose around the side wall of the container proximate the top open end, the upper bumper comprising a ring with an inner surface in contact with the side wall of the container and an outer surface, and a lower bumper configured to couple to the bottom closed end of the container, the lower bumper comprising a base in contact with the bottom closed end of the container and a side wall continuously connected to the base and in contact with the side wall of the container, the base of the lower bumper comprising a plurality of internal ridges in contact with the bottom closed end of the container, wherein the plurality of internal ridges of the lower bumper is configured to deform to absorb and redirect the impact forces from contact with the object away from the container.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
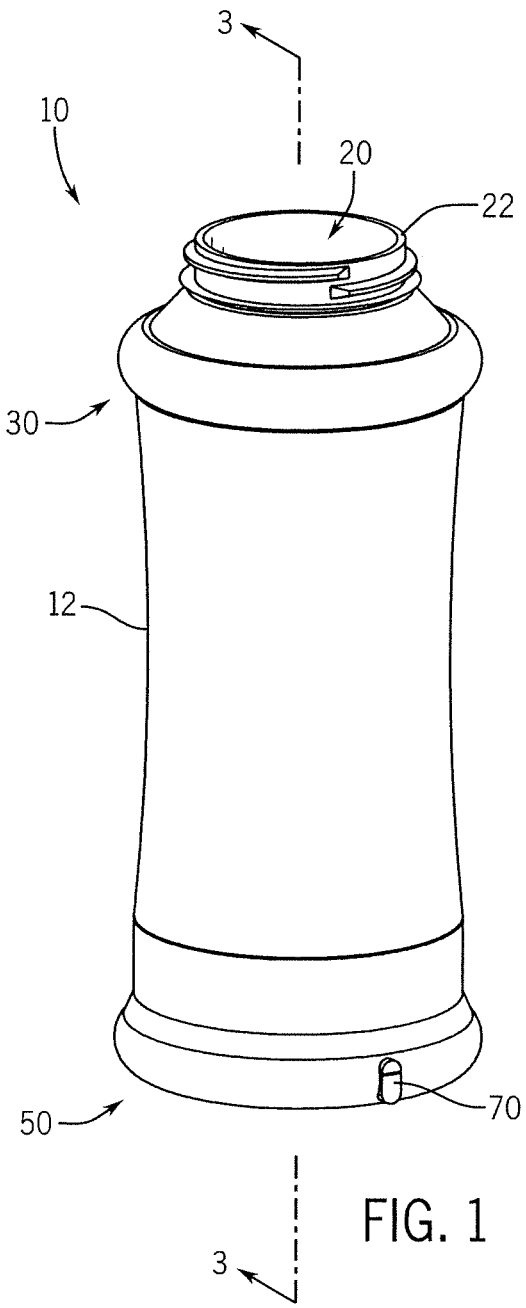
FIG. 1 depicts a front perspective view of certain embodiments of the protective cover apparatus shown in use.
Figure 2:
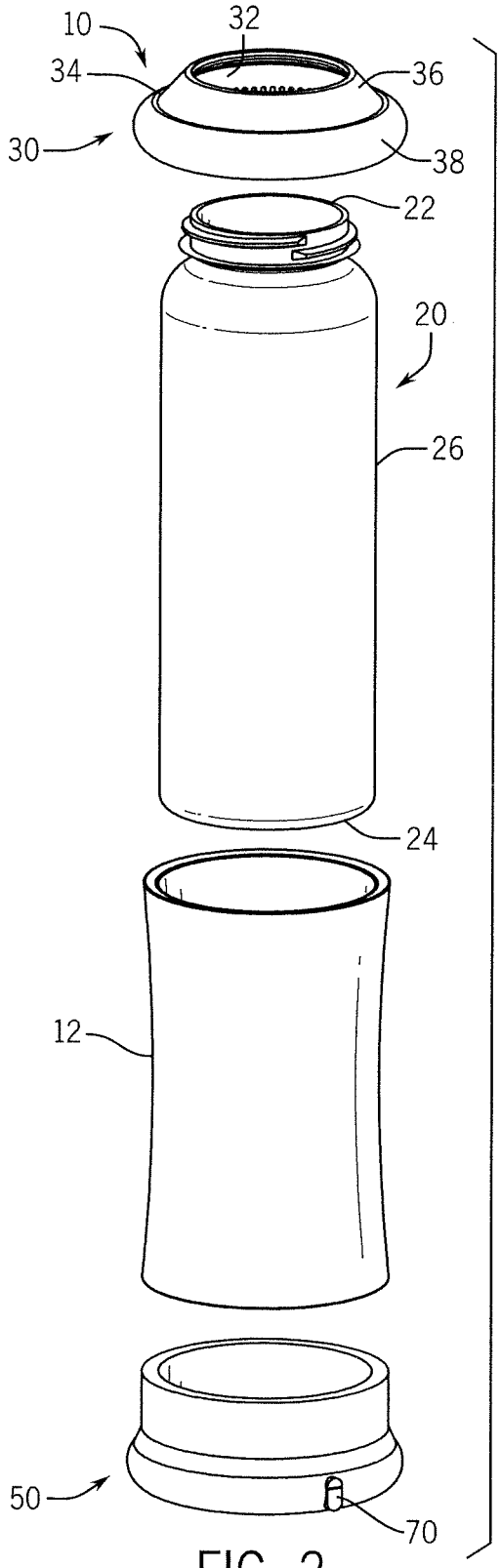
FIG. 2 depicts an exploded view of certain embodiments of the protective cover apparatus.
Figure 3:
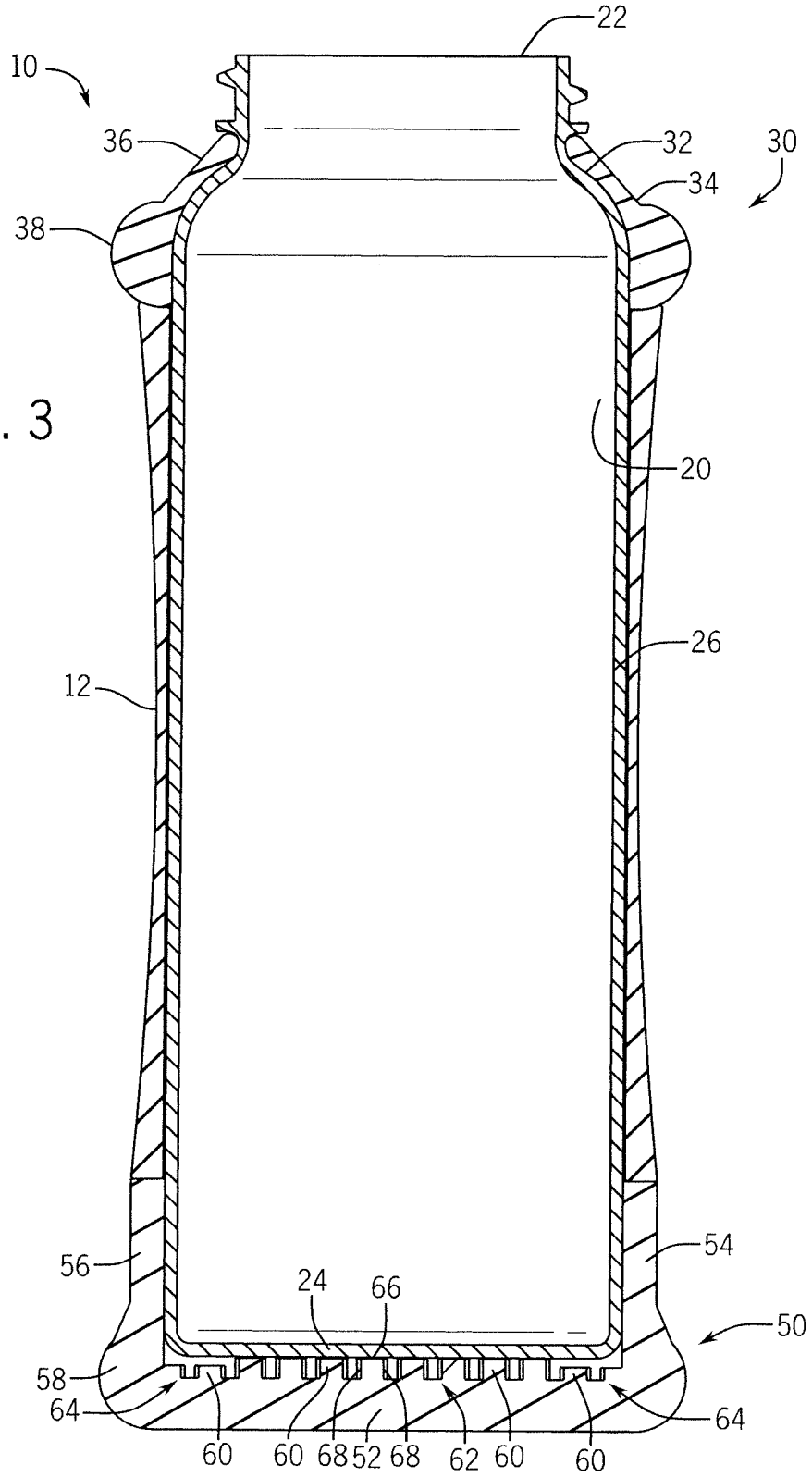
FIG. 3 depicts a cross-sectional view of certain embodiments of the protective cover apparatus taken along line 3-3 of FIG. 1.

In certain embodiments as depicted in FIGS. 1-3, protective cover apparatus 10 is configured for use with container 20, which may include, but is not limited to, bottles, canisters, flasks and other containers. Container 20 may be made from stainless steel, other metals, glass or other materials. In one embodiment, container 20 comprises top open end 22 continuously connected to closed bottom end 24 by side wall 26.

Protective cover apparatus 10 is configured to minimize and/or prevent abrasions, deformation and/or other damage to container 20 caused by forces of high impact, drops and kinetic energy associated with contact with another object such as the floor, table or other items. As such, protective cover apparatus 10 helps to preserve the structural integrity of container 20, which allows it to maintain its original functionality for a longer period of time.

Figure 6:
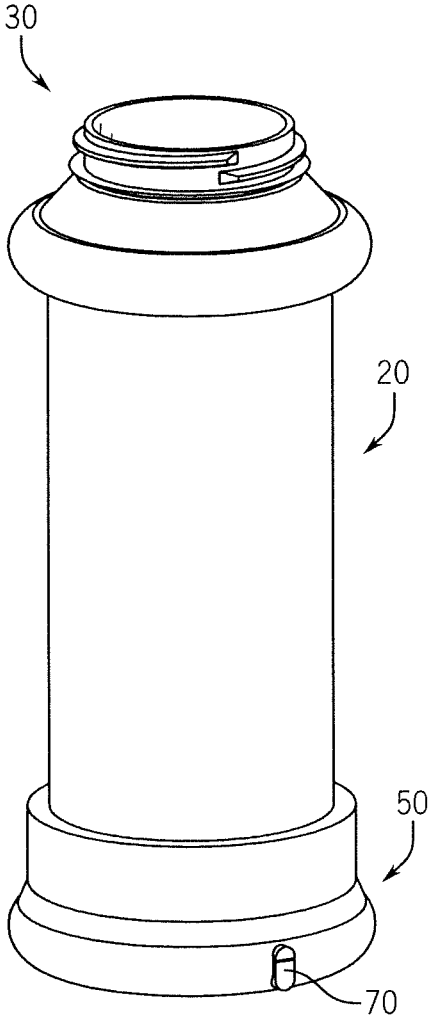
FIG. 6 depicts a perspective view of certain embodiments of the protective cover apparatus shown in use.
Figure 7:
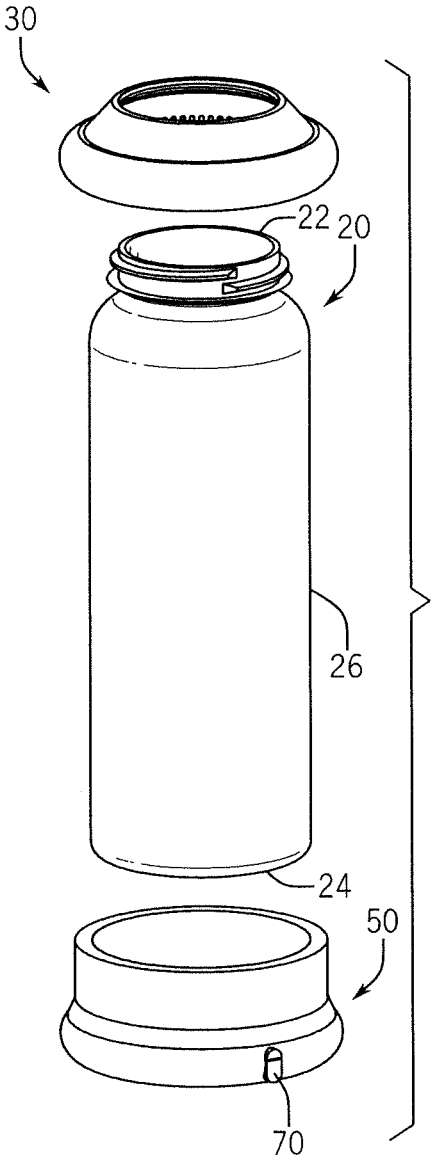
FIG. 7 depicts an exploded view of certain embodiments of the protective cover apparatus.

In one embodiment as depicted in FIGS. 6-7, protective cover apparatus 10 comprises upper bumper 30 and lower bumper 50. In one embodiment as depicted in FIGS. 1-3, protective cover apparatus 10 comprises sleeve 12, upper bumper 30 and lower bumper 50.

In one embodiment as depicted in FIGS. 1-4 and 6-7, upper bumper 30 comprises a ring that is configured to dispose around sidewall 26 of container 20 and be positioned proximate top open end 22. Upper bumper 30 is slidably mounted to container 20 and can easily snap on and off container 20 as needed. In one embodiment as depicted in FIG. 3, upper bumper 30 comprises inner surface 32 in contact with container 20 and outer surface 34. Outer surface 34 of upper bumper 30 comprises upper portion 36 having a slanted surface continuously connected to lower portion 38 having a convex surface. In one embodiment, lower portion 38 of upper bumper 30 comprises a maximum thickness of approximately 12 millimeters. In alternative embodiments, lower portion 38 of upper bumper 30 can have other thicknesses.

Figure 4:
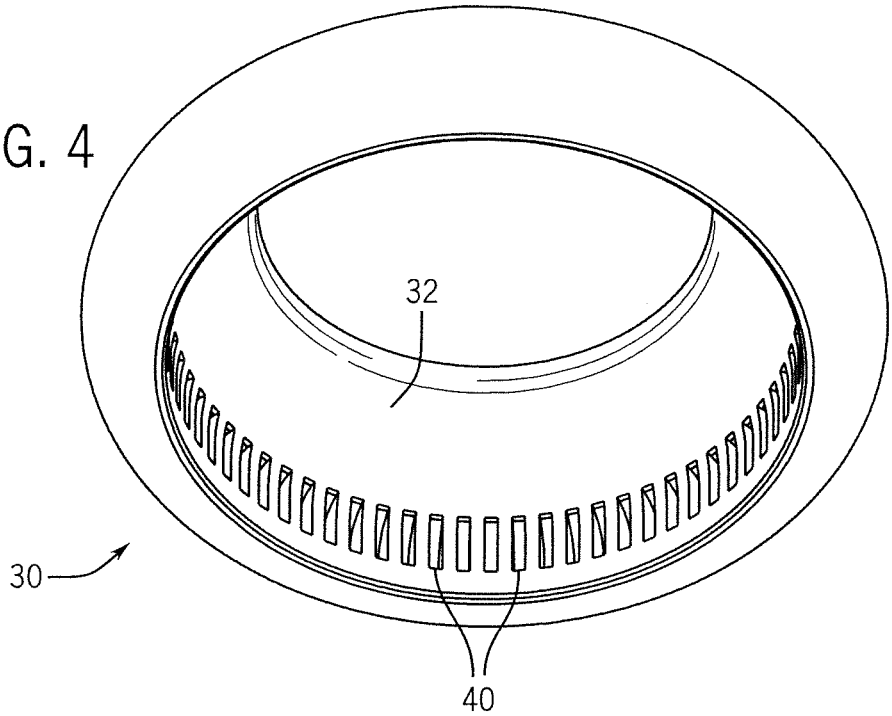
FIG. 4 depicts a bottom perspective view of certain embodiments of the protective cover apparatus illustrating upper bumper 30.

In one embodiment as depicted in FIG. 4, inner surface 32 of upper bumper 30 comprises a plurality of elongated cutouts 40. Elongated cutouts 40 serve as compression fins to enhance the flexibility of upper bumper 30 to enable it to deform and conform to contours of container 20 as depicted in FIG. 3. Further, elongated cutouts 40 enhance the impact durometer of upper bumper 30. In one embodiment, elongated cutouts 40 are oriented generally parallel to each other on upper bumper 30. Each elongated cutout 40 is separated the same distance from each adjacent elongated cutout 40 on upper bumper 30.

It shall be appreciated that the size, shape and location of elongated cutouts 40 can vary on upper bumper 30 in alternative embodiments. In one embodiment, each elongated cutout 40 comprises a height of approximately 10 millimeters and a depth of approximately 5 millimeters. In one embodiment, elongated cutouts 40 comprise semicircular-shaped voids in upper bumper 30.

Figure 5:
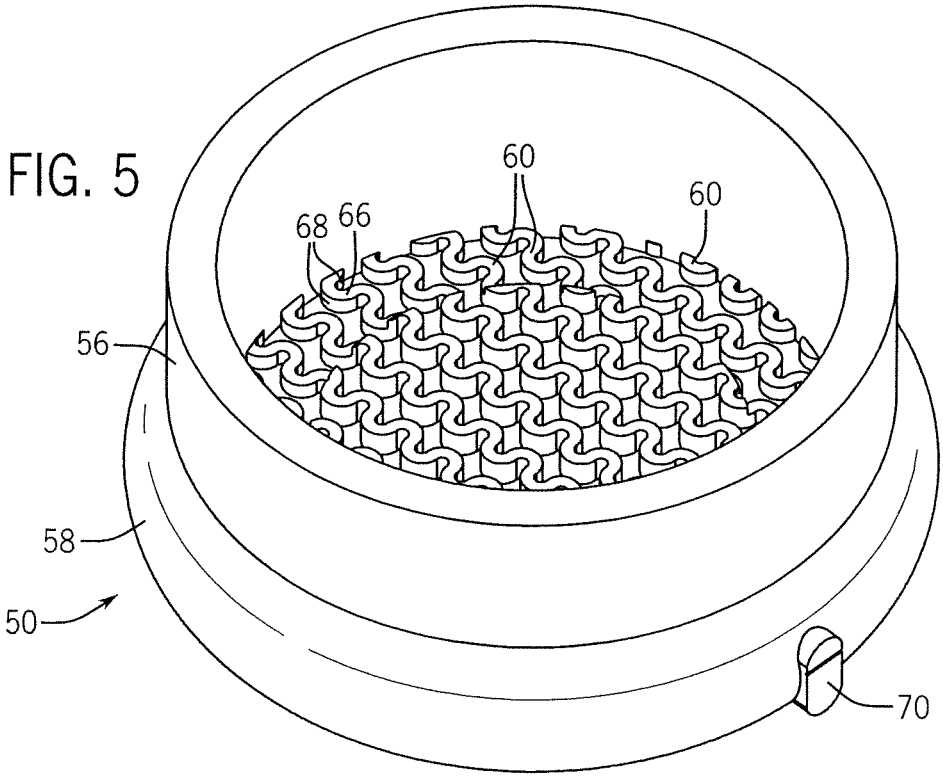
FIG. 5 depicts a top perspective view of certain embodiments of the protective cover apparatus illustrating lower bumper 50.

In one embodiment as depicted in FIGS. 1-3 and 5-7, lower bumper 50 is configured to dispose around sidewall 26 and closed bottom end 24 of container 20. In this embodiment, lower bumper 50 is slidably mounted to container 20 and can easily snap on and off container 20 as needed. As depicted in FIGS. 3 and 5, lower bumper 50 comprises base 52 continuously connected to side wall 54. In one embodiment, base 52 comprises a maximum thickness of approximately 14 millimeters. However, this thickness can vary in alternative embodiments.

In one embodiment, lower bumper 50 comprises lower portion 58 comprising a first outer diameter in sidewall 54 that is greater than a second outer diameter of upper portion 56 in sidewall 54. With lower bumper 50 coupled to closed bottom end 24 of container 20, the wider diameter of the bumper at lower portion 58 enhances upright stability of container 20 on a flat surface such as a table. In one embodiment, upper portion 56 of sidewall 54 comprises a thickness of approximately 7 millimeters. However, this thickness can vary in alternative embodiments.

In one embodiment as depicted in FIGS. 3 and 5, base 52 of lower bumper 50 comprises a plurality of internal ridges 60 that form a wave table that contacts closed bottom end 24 of container 20. In one embodiment, each internal ridge 60 comprises top surface 66 in contact with closed bottom end 24 of container 20 and a pair of opposing undulate side surfaces 68. Each undulate side surface 68 on internal ridge 60 comprises a sinusoidal-shaped surface that faces side wall 54 of lower bumper 50.

The plurality of internal ridges 60 on lower bumper 50 provides stability to container 20 and deform in the presence of impact forces generated during contact with another object. The deformation of internal ridges 60 allow lower bumper 50 to absorb and redirect the impact forces and associated kinetic energy away from the bottom of container 20.

In one embodiment as depicted in FIG. 3, the plurality of internal ridges 60 is organized into first set 62 of internal ridges 60 that is aligned with a central portion of closed bottom end 24 of container 20 and second set 64 of internal ridges 60 that is aligned along portions of the perimeter of closed bottom end 24 of container 20. In one embodiment, first set 62 of internal ridges 60 comprises a height of approximately 5 millimeters or another alternate height that allows first set 62 of internal ridges 60 to contact container 20. In one embodiment, second set 64 of internal ridges 60 comprises a height of approximately 3 millimeters. The shorter height of second set 64 of internal ridges 60 creates space to accommodate the edge or ridge present on closed bottom end 24 of certain types of containers 20 such as glass bottles. In an alternative embodiment, the height of second set 64 of internal ridges 60 can vary.

In an alternative embodiment, the height of internal ridges 60 can be consistent to accommodate container 20 having a flat closed bottom end 24. In one embodiment as depicted in FIGS. 1-2 and 5-7, tab 70 is coupled to side wall 54 of lower bumper 50. Tab 70 can have variable shapes and sizes, and is designed to serve as a roll stop that minimizes rolling motion of lower bumper 50 and container 20 on a surface. As such, tab 70 is beneficial for preventing container 20 when in a horizontal position from rotating off a flat, inclined or declined surface, and onto the floor. It shall be appreciated that tab 70 can be located on different locations on lower bumper 50 in alternative embodiments. In one embodiment, tab 70 comprises any combination of logos, symbols and/or characters embossed on its surface. In an alternative embodiment, lower bumper 50 can have multiple tabs 70. It shall be appreciated that upper bumper 30 can also have one or more tabs 70 in alternative embodiments.

In one embodiment, upper and lower bumpers 30, 50 can be made from a high-grade silicone and/or rubber material that comprises a durometer of approximately 50 A-55 A. This provides a hardness in the upper and lower bumpers 30, 50 that allows them to deform and maintain resiliency in order to slide on and off container 20 with ease, and to absorb and/or redirect impact forces and kinetic energy generated during contact with another object such as a table, floor or other object.

However, it shall be appreciated that the type of material and degree of hardness in upper and lower bumpers 30, 50 can vary in alternative embodiments.

In operation, upper and lower bumpers 30, 50 are disposed around sidewall 26 of container 20 as previously described and shown in FIG. 6. Upper and lower bumpers 30, 50 serve as deformable barriers near top open end 22 and closed bottom end 24 of container 20 to absorb impact forces generated during contact with another object. The deformation of upper and lower bumpers 30, 50 redirect the impact forces and associated kinetic energy away from container 20, thereby minimizing and/or preventing abrasions, deformation and/or other damage to container 20. In addition, the wider diameter lower portion 58 and internal ridges 60 of lower bumper 50 serve as first and second lines of defense against sudden lower impacts with other objects, helping to redistribute and offset kinetic energy away from container 20.

In one embodiment, upper and lower bumpers 30, 50 elevate container 20 in the horizontal position above a flat surface such as a table. This eliminates contact between side wall 26 of container 20 and the table or other objects, thereby enhancing protection of container 20 from direct impacts or surface-to-surface contact with these objects.

In one embodiment as depicted in FIGS. 1-3, protective cover apparatus 10 comprises sleeve 12, which can slide on and off side wall 26 of container 20 as needed. In one embodiment as depicted in FIGS. 1 and 3, sleeve 12 is disposed around sidewall 26 and is in contact with both upper bumper 30 and lower bumper 50. Sleeve 12 provides additional protection to side wall 26 of container 20 to minimize and/or prevent damage such as abrasions, scuffs, dents and the like.

The use of sleeve 12 in conjunction with upper and lower bumpers 30, 50 has several additional advantages. Specifically, sleeve 12 enhances the insulative value of protective cover apparatus 10 and serves as a grip for the user to grab when carrying container 20. By allowing sleeve 12 and upper and lower bumpers 30, 50 to absorb kinetic energy from impacts, these components serve as a noise reducing and/or canceling feature that reduces and/or eliminates harmonic vibrations and noise during impacts between container 20 and another object.

Sleeve 12 can have several variations. In one embodiment, sleeve 12 is a silicone sleeve that permits another outer protective sleeve (not shown) to be disposed thereon. The outer protective sleeve is made from carbon fiber or an alternate material. When used together on container 20, sleeve 12 and the outer protective sleeve provide maximum protection to side wall 26 of container 20. In one embodiment, sleeve 12 is made from acrylic, which is transparent to enable a user to view side wall 26 of container 20 and any colors, designs, symbols, stickers and the like present thereon. In an alternative embodiment, sleeve 12 is made from any alternative material or combination of materials in the field.

It shall be appreciated that protective cover apparatus 10 can have multiple configurations in different embodiments. In one embodiment, upper and lower bumpers 30, 50 of protective cover apparatus 10 are made from transparent or translucent silicone. In this embodiment, bumper 30, 50 houses an illumination device such as a LED assembly or other light source that allows light to pass through the bumper to enhance visibility of protective cover apparatus 10. It shall be appreciated that either bumper or both upper and lower bumpers 30, 50 can house illumination devices at the same time.

The illumination device is advantageous for geolocation purposes in which protective cover apparatus 10 can be used in conjunction with components such as remote controls, signal devices and other components. Further, the illumination device allows users to use protective cover apparatus 10 as a safety device to emit flashing red or amber lights during an emergency. Finally, the illumination device enhances aesthetics of the protective cover apparatus 10 to achieve the desired color and/or pattern of the user.

It shall be appreciated that the components of protective cover apparatus 10 described in several embodiments herein may comprise any alternative known materials in the field and be of any color, size and/or dimensions. It shall be appreciated that the components of protective cover apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A protective cover apparatus with enhanced shock absorbing capability configured to couple to a container to minimize abrasions, deformation and damage to the container due to impact forces generated from contact with an object, the container comprising a top open end continuously connected to a closed bottom end by a side wall, the protective cover apparatus comprising:

an upper bumper configured to dispose around the side wall of the container proximate the top open end, the upper bumper comprising a ring with an inner surface in contact with the side wall of the container and an outer surface; and a lower bumper configured to couple to the closed bottom end of the container, the lower bumper comprising a base in contact with the closed bottom end of the container and a side wall continuously connected to the base and in contact with the side wall of the container, the base of the lower bumper comprising a plurality of internal ridges in contact with the closed bottom end of the container, wherein the plurality of internal ridges of the lower bumper is configured to deform to absorb and redirect the impact forces from contact with the object away from the container, wherein each internal ridge in the plurality of internal ridges of the lower bumper comprises a pair of opposing undulate side surfaces, and a flat wavy top surface, wherein the plurality of internal ridges form a wave table configured to contact said closed bottom end of the container, wherein the upper bumper and the lower bumper are two separate pieces configured to independently connect to the container, and to leave a section of the container between the top end and the closed bottom end uncovered.

2. The protective cover apparatus of claim 1, each undulate side surface in the pair of undulate side surfaces comprising a sinusoidal-shaped surface facing the side wall of the lower bumper.

3. The protective cover apparatus of claim 2, wherein the side wall of the lower bumper comprises an upper portion and a lower portion, the lower portion of the side wall of the lower bumper comprising a first outer diameter that is greater than a second outer diameter of the upper portion of the side wall of the lower bumper.

4. The protective cover apparatus of claim 3, further comprising a tab coupled to the side wall of the lower bumper, the tab configured to minimize rolling motion of the lower bumper on a surface.

5. The protective cover apparatus of claim 4, wherein the inner surface of the upper bumper comprises a plurality of elongated cutouts oriented generally parallel to each other, the plurality of elongated cutouts configured to enhance flexibility of the upper bumper to conform to contours of the container, wherein the plurality of elongated cutouts create compression fins within the upper bumper, wherein the outer surface opposite the cutouts is continuous and uninterrupted by the cutouts.

6. The protective cover apparatus of claim 5, wherein each elongated cutout in the plurality of elongated cutouts on the upper bumper is located a same distance from each adjacent elongated cutout in the plurality of elongated cutouts on the upper bumper.

7. The protective cover apparatus of claim 5, wherein the outer surface of the upper bumper comprises an upper portion continuously connected to a lower portion, the upper portion of the outer surface of the upper bumper comprising a slanted surface and the lower portion of the outer surface of the upper bumper comprising a convex surface.

8. The protective cover apparatus of claim 7, wherein the upper and lower bumpers are made from a material with a durometer of approximately 50 A-55 A.

9. The protective cover apparatus of claim 7, further comprising a sleeve configured to dispose around the side wall of the container and contact both the upper and lower bumpers.

10. The protective cover apparatus of claim 1, wherein the plurality of internal ridges includes a first set of internal ridges that is configured to align with a central portion of the closed bottom end of the container, and a second set of internal ridges that is configured to align along portions of a perimeter of the closed bottom end of the container, wherein the first set of internal ridges has a height that is greater than the height of the second set of internal ridges thereby creating a wave table having two different heights.

11. The protective cover apparatus of claim 1, wherein the plurality of internal ridges includes a first set of internal ridges and second set of internal ridges, wherein the first set of internal ridges has a height that is greater than the height of the second set of internal ridges thereby creating a wave table having two different heights.

12. The protective cover apparatus of claim 7, wherein the compression fins are disposed at a lower portion of the inner surface, opposite the convex surface.

13. A protective cover apparatus with enhanced shock absorbing capability configured to couple to a container to minimize abrasions, deformation and damage to the container due to impact forces generated from contact with an object, the container comprising a top open end continuously connected to a closed bottom end by a side wall, the protective cover apparatus comprising:

an upper bumper configured to dispose around the side wall of the container proximate the top open end, the upper bumper comprising a ring with an inner surface in contact with the side wall of the container and an outer surface;

a sleeve configured to dispose around the side wall of the container and contact the upper bumper;

a lower bumper configured to couple to the closed bottom end of the container and contact the sleeve, the lower bumper comprising a base in contact with the closed bottom end of the container and a side wall continuously connected to the base and in contact with the side wall of the container, the base of the lower bumper comprising a plurality of internal ridges in contact with the closed bottom end of the container, wherein the plurality of internal ridges of the lower bumper is configured to deform to absorb and redirect the impact forces from contact with the object away from the container, wherein each internal ridge in the plurality of internal ridges of the lower bumper comprises a pair of opposing undulate side surfaces, and a flat wavy top surface, wherein the plurality of internal ridges form a wave table configured to contact said closed bottom end of the container, wherein the upper bumper, the sleeve, and the lower bumper are separate units configured to connect independently to the container.

* * * * *